US007498538B1

(12) United States Patent
Tittle

(10) Patent No.: US 7,498,538 B1
(45) Date of Patent: Mar. 3, 2009

(54) SLIDING CONTACT SWITCH

(75) Inventor: Michael D. Tittle, Harbor City, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 0 days.

(21) Appl. No.: 11/880,248

(22) Filed: Jul. 20, 2007

(51) Int. Cl.
*H01H 1/36* (2006.01)

(52) U.S. Cl. ..... 200/536

(58) Field of Classification Search ..... 200/241–242, 200/536, 535, 16 A, 243, 275, 295, 303, 345; 439/188
See application file for complete search history.

(56) References Cited

U.S. PATENT DOCUMENTS

| | | | |
|---|---|---|---|
| 2,355,459 | A | 8/1944 | Miskella |
| 2,422,097 | A | 6/1947 | Hansen |
| 2,478,564 | A | 8/1949 | Bordelon |
| 2,966,561 | A | 12/1960 | Durrant |
| 3,012,219 | A | 12/1961 | Levin et al. |
| 3,204,067 | A | 8/1965 | Brown |
| 3,226,991 | A | 1/1966 | Hartsock |
| 3,329,784 | A | 7/1967 | Rogero |
| 3,445,796 | A | 5/1969 | Spiroch et al. |
| 3,454,733 | A | 7/1969 | Sanford et al. |
| 3,463,491 | A | 8/1969 | Shaw |
| 3,472,721 | A | 10/1969 | Abramson et al. |
| 3,509,317 | A | 4/1970 | Valsamakis et al. |
| 3,510,069 | A | 5/1970 | Hannum |
| 3,523,168 | A | 8/1970 | Holmes |
| 3,535,478 | A | 10/1970 | Lewis |
| 3,588,425 | A | 6/1971 | Erickson |
| 3,591,747 | A | 7/1971 | Dennison |
| 3,592,992 | A | 7/1971 | Costello |
| 3,598,948 | A | 8/1971 | Bowen et al. |
| 3,600,553 | A | 8/1971 | Costello |
| 3,649,811 | A | 3/1972 | Schoenthaler |
| 3,657,508 | A | 4/1972 | Studnick |
| 3,668,579 | A | 6/1972 | Harman |
| 3,674,974 | A | 7/1972 | Costello |

(Continued)

FOREIGN PATENT DOCUMENTS

| | | |
|---|---|---|
| FR | 1362299 | 9/1964 |

(Continued)

OTHER PUBLICATIONS

Judco Manufacturing drawings (redacted) of prior switch assembly on sale at least as early as 2002 (4 sheets).

(Continued)

*Primary Examiner*—Edwin A. Leon
(74) *Attorney, Agent, or Firm*—Michael Zarrabian, Esq.; Myers Dawes Andras & Sherman, LLP

(57) ABSTRACT

An electrical contact assembly includes an electrical terminal, a push button, and a contact member adapted to be in electrical contact with the electrical terminal when the push button is compressed. The contact member has a first contact portion forming a first angle with a surface of the electrical terminal, and a second contact portion forming a second angle with the surface of the electrical terminal. The second angle is smaller than the first angle, and the second contact portion is adapted to slide on the surface of the electrical terminal when the push button is compressed.

25 Claims, 14 Drawing Sheets

U.S. PATENT DOCUMENTS 3,674,975 A 7/1972 Nugent et al.
3,694,603 A 9/1972 Congelliere et al.
3,744,557 A 7/1973 Costello
3,760,312 A 9/1973 Shlesinger, Jr.
3,763,348 A 10/1973 Costello
3,788,560 A 1/1974 Hough et al.
3,790,912 A 2/1974 Murphy ..... 335/205
3,801,753 A 4/1974 Szymber
3,809,838 A * 5/1974 Coppola ..... 200/532
3,899,236 A 8/1975 Santos
3,910,672 A 10/1975 Frantz ..... 439/405
3,931,487 A 1/1976 Russenberger
3,974,469 A 8/1976 Nicholls
3,993,885 A 11/1976 Kominami et al.
4,006,322 A * 2/1977 Gallatin et al. ..... 200/241
4,019,801 A 4/1977 Hoffman
4,041,427 A 8/1977 Chusha ..... 335/205
4,052,580 A * 10/1977 Stanish ..... 200/535
4,055,736 A 10/1977 Congelliere
4,062,626 A 12/1977 Kawakami et al.
4,089,047 A 5/1978 Luderitz
4,152,755 A 5/1979 Trosper et al. ..... 362/158
4,169,974 A 10/1979 Peers-Trevarton
4,175,222 A 11/1979 Buttner
4,203,017 A 5/1980 Lee
4,241,244 A 12/1980 Swann
4,252,395 A 2/1981 Ward et al.
4,308,440 A 12/1981 Buttner
4,317,015 A 2/1982 Buttner et al.
4,319,106 A 3/1982 Armitage
4,335,287 A 6/1982 Aschenbach et al.
4,345,128 A 8/1982 Buttner et al.
4,413,872 A 11/1983 Rudy et al. ..... 439/467
4,419,169 A 12/1983 Becker et al.
4,419,304 A 12/1983 Ficke et al.
4,460,820 A 7/1984 Matsumoto et al.
4,461,528 A 7/1984 Durand et al.
4,476,359 A 10/1984 Bienwald
4,496,803 A * 1/1985 Smith ..... 200/5 A
4,506,124 A 3/1985 Rose et al.
4,524,253 A 6/1985 Sorenson
4,529,258 A 7/1985 Anthony ..... 439/142
4,541,679 A 9/1985 Fiedler et al. ..... 439/395
4,575,590 A 3/1986 Hattori et al.
4,605,839 A 8/1986 Rasmussen et al.
4,660,919 A 4/1987 Levy ..... 439/418
4,691,086 A * 9/1987 Habecker et al. ..... 200/241
4,692,573 A 9/1987 Fukuyama et al.
4,713,498 A 12/1987 Ludwig et al.
4,754,104 A 6/1988 Maltais et al. ..... 200/11 R
4,771,141 A 9/1988 Flumignan et al.
4,788,403 A 11/1988 Hayakawa et al.
4,795,860 A 1/1989 Kamada et al.
4,812,620 A 3/1989 Hayakawa et al.
4,858,090 A 8/1989 Downs
4,885,443 A 12/1989 Simcoe et al.
4,891,018 A 1/1990 Afflerbaugh et al.
4,891,476 A 1/1990 Nation et al.
4,906,808 A 3/1990 Burgess et al.
4,939,328 A 7/1990 Smith
4,978,823 A 12/1990 Sato et al.
5,001,316 A 3/1991 Salaman
5,043,546 A 8/1991 Krause
5,049,709 A 9/1991 Prickett et al.
5,060,289 A 10/1991 Abramson
5,063,276 A 11/1991 Woodard
5,132,499 A 7/1992 Valenzona et al.
5,145,059 A 9/1992 Park
5,158,172 A 10/1992 Roeser et al.
5,178,265 A 1/1993 Sepke
5,186,316 A 2/1993 Mortun et al.
5,194,703 A 3/1993 Deeg
5,201,408 A 4/1993 Torma et al.
5,226,529 A 7/1993 Valenzona
5,268,542 A 12/1993 Voll
5,285,037 A 2/1994 Baranski et al.
5,293,507 A 3/1994 Hayakawa
5,435,747 A 7/1995 Franckx et al.
5,442,150 A 8/1995 Ipcinski
5,493,089 A 2/1996 Chasen et al.
5,514,006 A 5/1996 Getselis et al.
5,541,376 A 7/1996 Ladtkow et al.
5,586,645 A 12/1996 Bartok
5,620,086 A 4/1997 Bianca et al.
5,629,659 A 5/1997 Steiner
5,636,729 A 6/1997 Wiciel
5,675,890 A 10/1997 Yamamoto et al.
5,681,182 A 10/1997 Reichle
5,762,707 A 6/1998 Shindo
5,777,282 A 7/1998 Ishiguro et al.
5,785,548 A 7/1998 Capper et al. ..... 439/409
5,847,345 A 12/1998 Harrison
5,871,374 A 2/1999 Maney
5,924,557 A * 7/1999 Pollock ..... 200/241
5,954,534 A 9/1999 Hale et al. ..... 439/409
5,961,341 A 10/1999 Knowles et al. ..... 439/403
5,964,615 A 10/1999 Endres ..... 439/419
5,994,654 A 11/1999 Benson
5,999,072 A 12/1999 Slavik ..... 335/207
6,016,020 A 1/2000 Cline et al.
6,080,006 A 6/2000 Broder
6,093,048 A 7/2000 Arnett et al.
6,106,761 A 8/2000 Sjoberg et al.
6,180,905 B1 1/2001 Pollock et al.
6,191,376 B1 2/2001 Bartok
6,196,861 B1 3/2001 Saligny
6,231,373 B1 5/2001 Daoud
6,236,006 B1 5/2001 Wecke
6,254,421 B1 7/2001 Denovich et al. ..... 439/409
6,264,495 B1 7/2001 Robertson et al. ..... 439/409
6,312,282 B1 11/2001 Blaha et al.
6,406,324 B1 6/2002 Duesterhoeft et al. ..... 439/409
6,426,486 B1 7/2002 Bartok
6,537,101 B1 3/2003 Wang
6,635,838 B1 10/2003 Kornelson ..... 200/341
6,636,135 B1 10/2003 Vetter
6,682,363 B1 1/2004 Chang
6,729,016 B2 5/2004 Wieger et al.
6,737,596 B1 5/2004 Hein
6,864,454 B2 3/2005 Shimizu et al.
6,974,918 B2 12/2005 Blossfeld
7,090,529 B1 8/2006 Wang
7,256,671 B1 8/2007 Preaux ..... 335/207
2002/0106929 A1 8/2002 Nagai
2004/0163940 A1 8/2004 Ravnkilde et al.

FOREIGN PATENT DOCUMENTS

JP 09-257374 10/1977
WO WO 97/10936 3/1997

OTHER PUBLICATIONS

Eraser Company Inc., Syracuse New York, Glo-ring Infrared Heat tools.
"Tube Shrinking Systems" related to a Model 4825 easyShrink.TM. Workstation.

* cited by examiner

SLIDING CONTACT SWITCH

FIELD OF THE INVENTION

The present invention relates to an electrical system, and in particular to an electrical switch.

BACKGROUND OF THE INVENTION

Electrical switches are used to make electrical connections between electrical wires. Many electrical system failures result from bad contacts at electrical switches. The bad contacts may result from contaminations at contact surfaces or terminals, or may result from wearing of the contact surfaces and/or terminals.

BRIEF SUMMARY OF THE INVENTION

The present invention provides a method and system for making a reliable and durable contact between electrical terminals.

In one aspect, an electrical contact assembly according to an embodiment of the present invention includes an electrical terminal, a push button, and a contact member. When the push button is compressed, the contact member comes in electrical contact with the terminal. The contact member has a first contact portion forming a first angle with a surface of the electrical terminal, and a second contact portion forming a second angle with the surface of the electrical terminal. The second angle is smaller than the first angle, and the second contact portion is adapted to slide on the surface of the electrical terminal when the push button is compressed.

The electrical contact assembly may include a spring member coupled to the contact member and to the push button. The assembly may have a housing and a cover together substantially enclosing the electrical terminal and the contact member. The electrical terminal may be adapted for retaining, and being in electrical contact with, an electrical wire.

The contact member of the assembly may be formed unitarily, for example, using beryllium copper. Alternatively, portions of the contact member may be formed separately and then coupled together.

The contact member is adapted to provide a resilient force between the contact member and the electrical terminal when in electrical contact with the electrical terminal. The resilient force at least partially results from a change in a relative angle between the first contact portion and the second contact portion.

These and other features, aspects and advantages of the present invention will become understood with reference to the following description, appended claims and accompanying figures.

DETAILED DESCRIPTION OF THE INVENTION

Figure 1A:
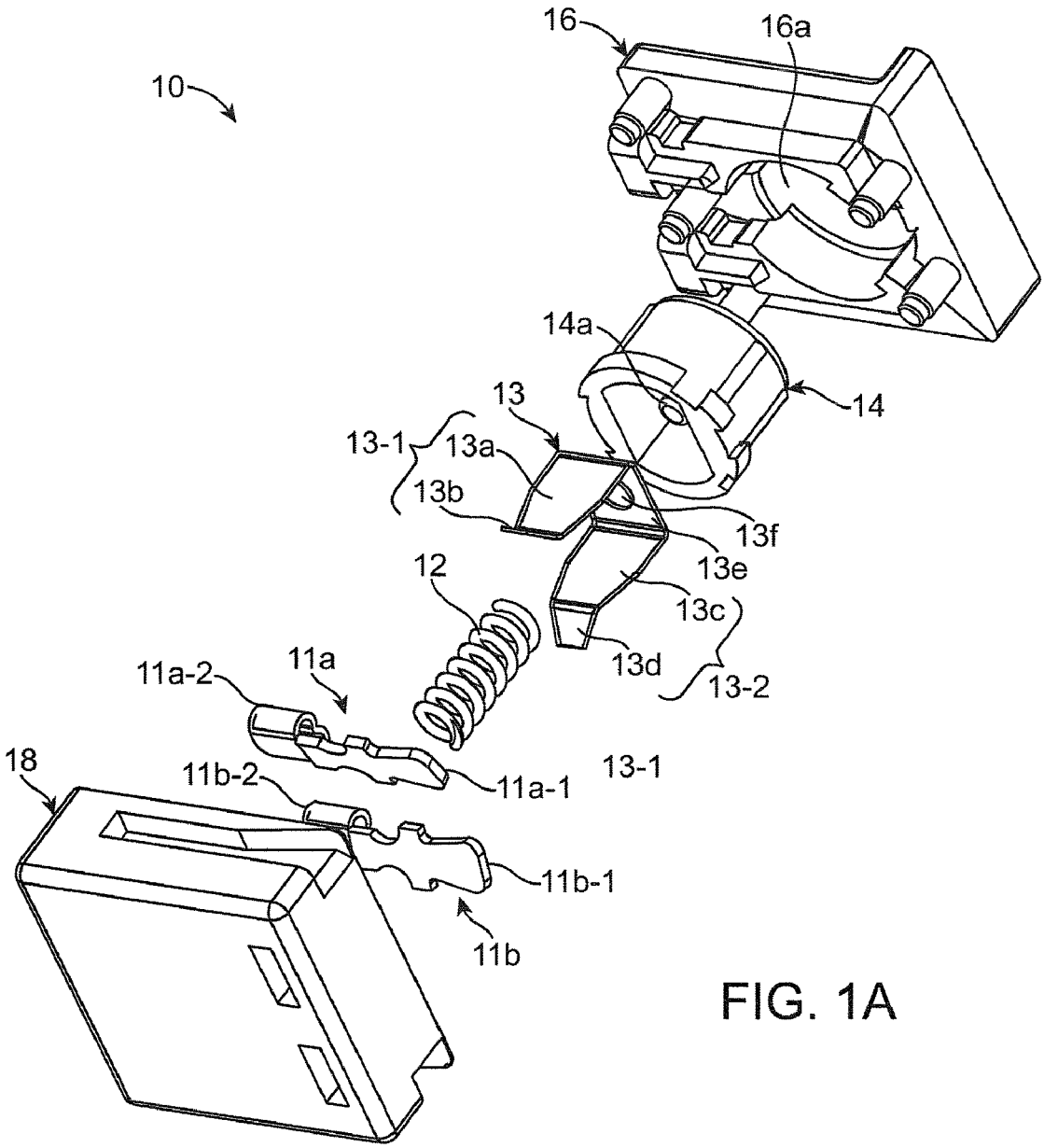
FIG. 1A is an exploded view of an electrical contact assembly according to an embodiment of the present invention.
Figure 1B:
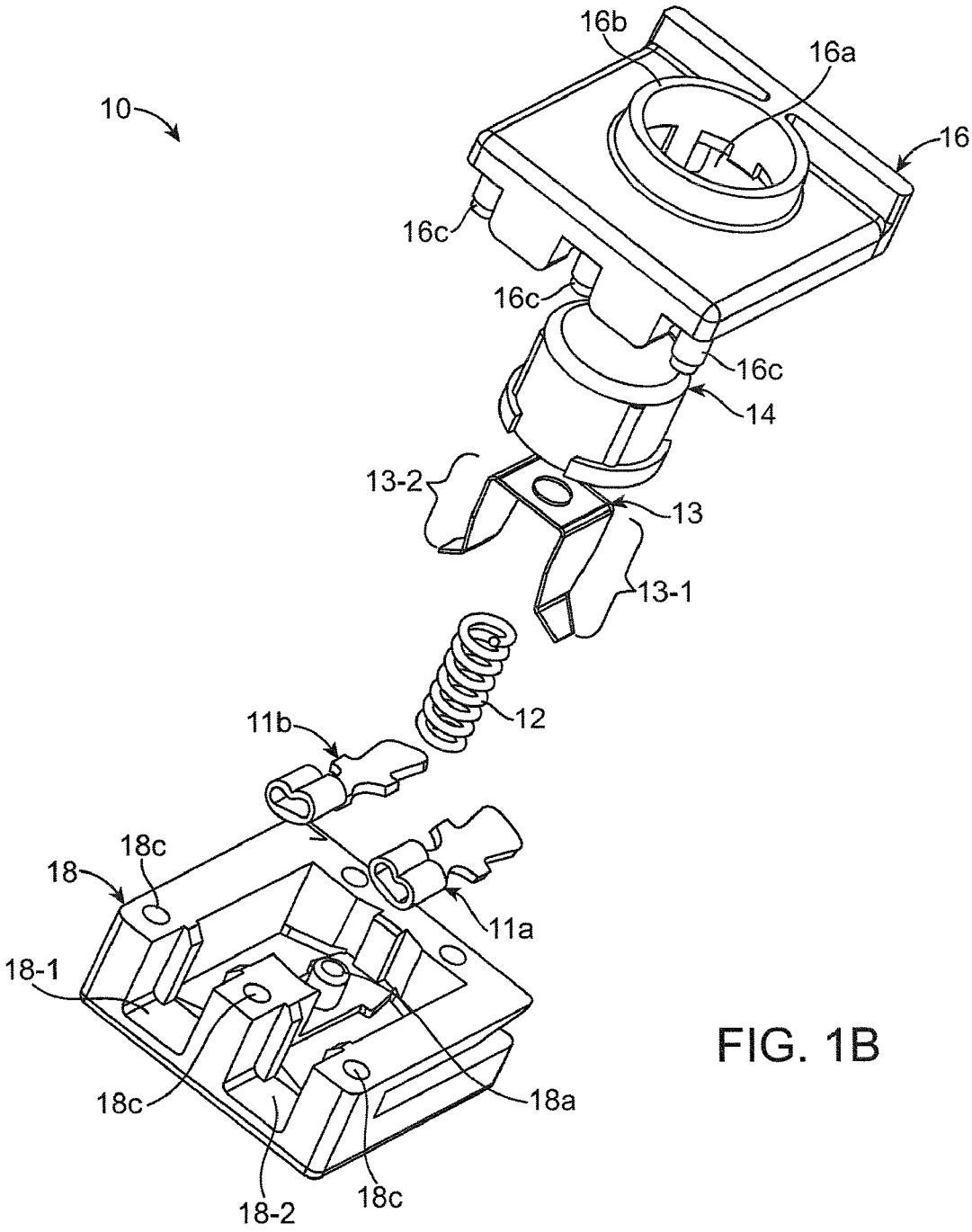
FIG. 1B shows another exploded view of the electrical contact assembly of FIG. 1A from a different angle.
Figure 2:
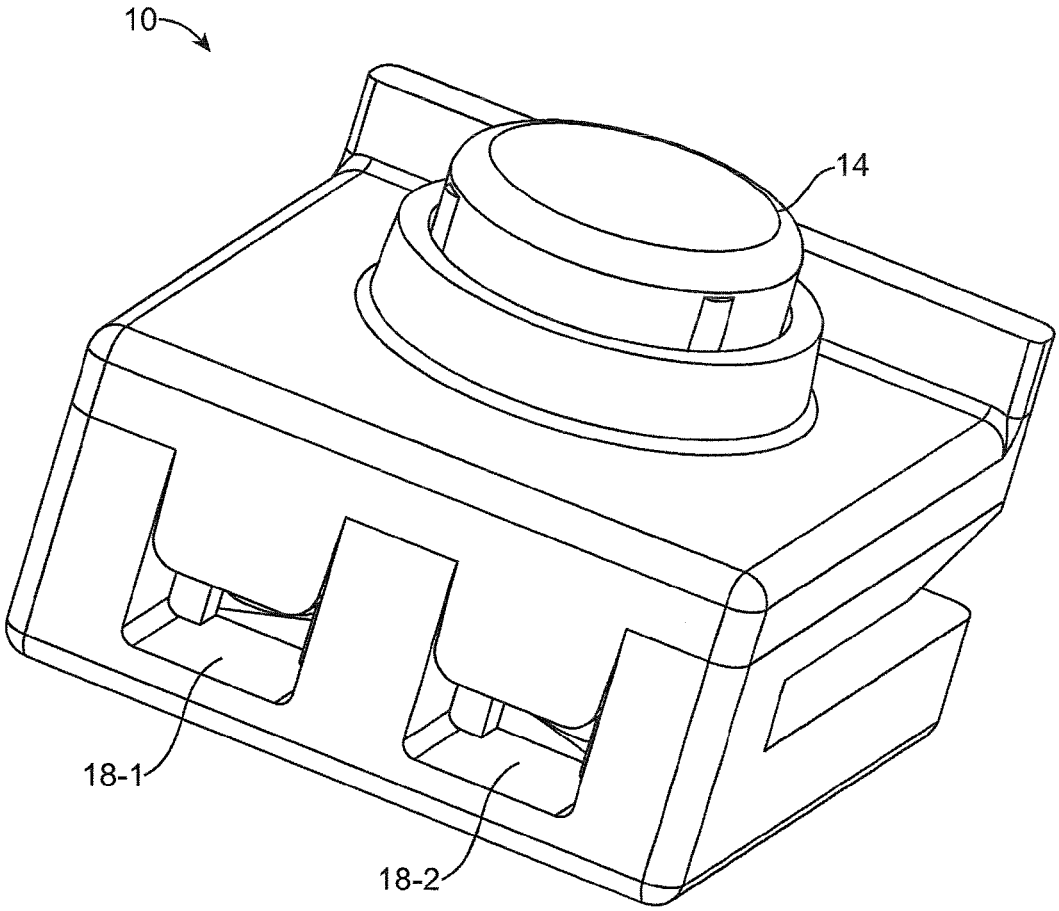
FIG. 2 is a perspective view of the assembled electrical contact assembly of FIGS. 1A and 1B.

The present invention provides a switch for connecting, for example, paired electrical wires. As shown in FIGS. 1A, 1B and 2, an electrical contact assembly or switch 10 in accordance with an embodiment of the invention includes one or more electrical terminals 11*a*, 11*b*, a spring member 12, a contact member 13, a push button 14, a housing 16, and a cover 18.

Figure 8A:
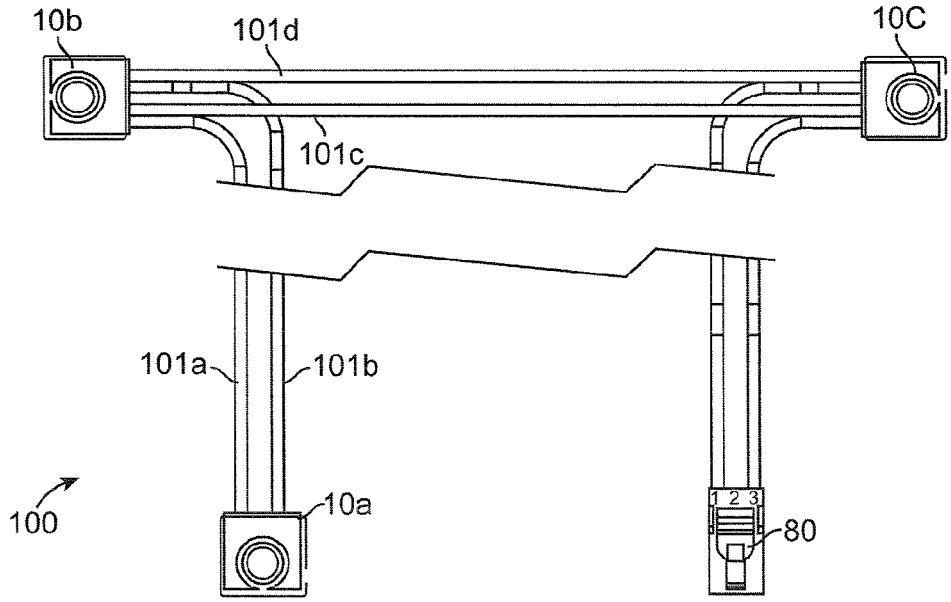
FIG. 8A shows a portion of an electrical system including a plurality of contact assemblies according to an embodiment of the invention.
Figure 8B:
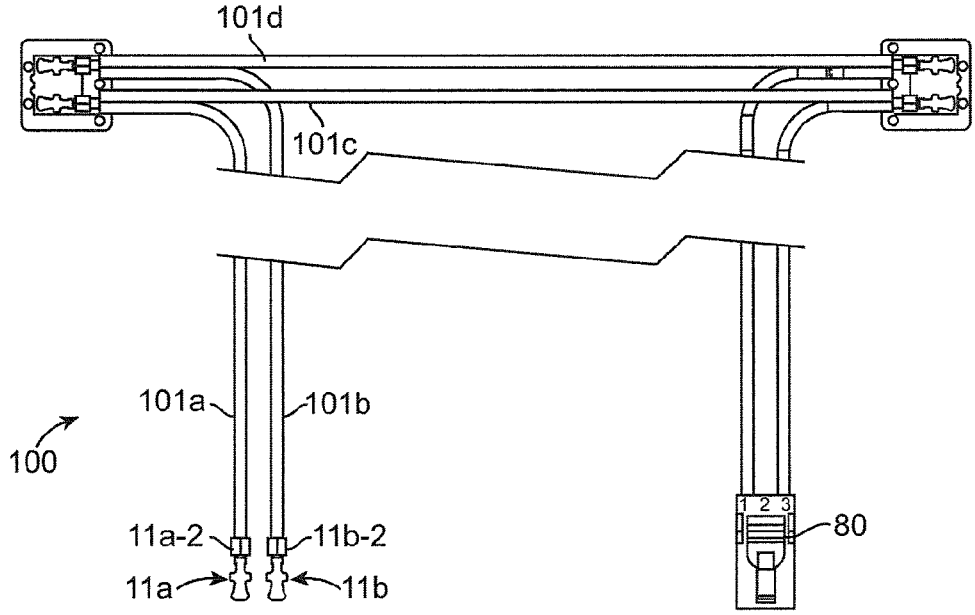
FIG. 8B shows the electrical system with the contact assemblies removed, exposing the electrical terminals, according to an embodiment of the invention.
Figure 8C:
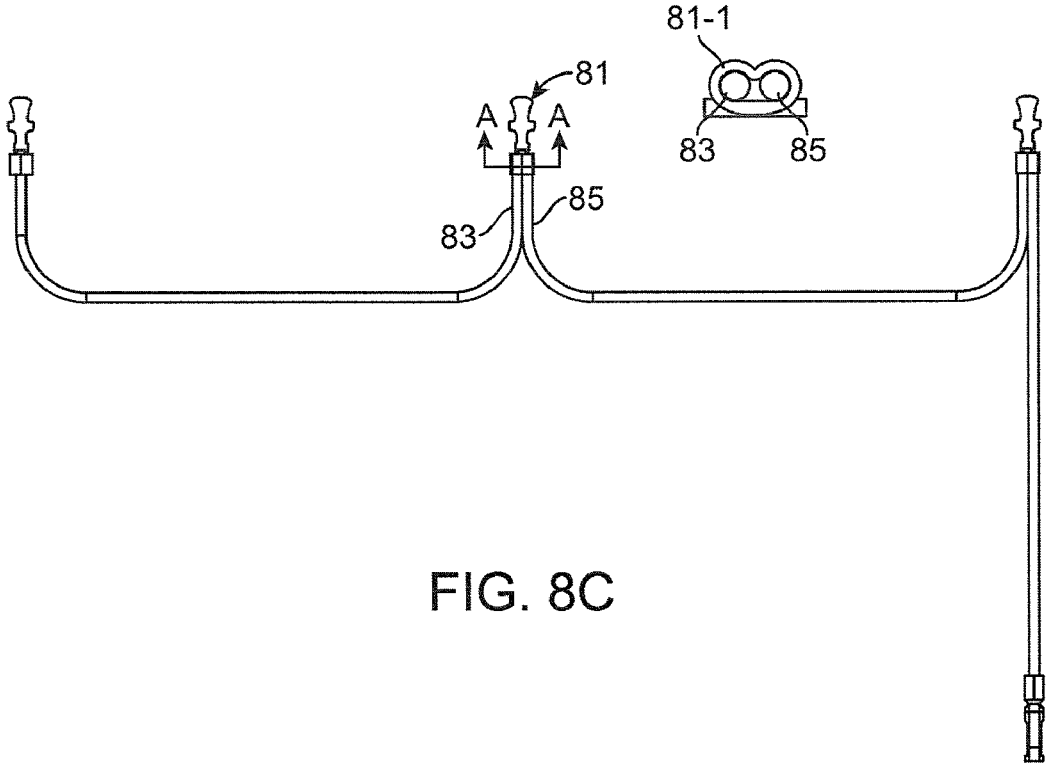
FIG. 8C shows further details of the electrical terminals, according to an embodiment of the invention.

The terminals 11*a* and 11*b* have retaining portions 11*a*-2 and 11*b*-2 that are adapted to retain electrical wires 101*a* and 101*b* (e.g., FIG. 8B). The electrical wires may be extended through apertures 18-1 and 18-2 in the assembly 10 formed by the housing 16 and the cover 18, to connect to an electrical circuit 100 (FIGS. 8A-8C). When assembled, the housing 16 and the cover 18 together substantially enclose the contact member 13 and the terminals 11*a* and 11*b*, and partially enclose the push button 14.

The contact member 13 has a first contact portion 13*a* and a second contact portion 13*b*. The second contact portion 13*b* as shown is at an angle in relation to the first contact portion 13*a*, i.e., the portion 13*b* is "bent" in relation to the portion 13*a*. The second contact portion 13*b* is adapted to come in contact with a surface 11*a*-1 of the first terminal 11*a*. The contact member 13 may further include a third contact portion 13*c* and a fourth contact portion 13*d*. The fourth contact portion 13*d* is bent in relation to portion 13*c*, and is adapted to come in contact with a surface 11*b*-1 of the second terminal 11*b*.

The contact member 13 is overall "U" shaped, with contact portions 13*a* and 13*b* forming a first "leg" 13-1, and contact portions 13*c* and 13*d* forming a second "leg" 13-2. The contact member 13 may also be of other shapes such as "V" shaped, etc. The contact member 13 may have more "legs"

and contact portions, and may be unitarily formed using, for example, beryllium copper. Alternatively, different portions, such as the first contact portion 13*a* and the second contact portion 13*b*, may be formed separately and then coupled together.

The push button 14 has an internal extrusion 14*a* adapted to extend through an aperture 13*f* of the top portion 13*e* of the contact member 13, and extend through a first portion of the spring member 12 thus retaining the first portion of the spring member 12 to a substantially fixed location. For a contact member 13 having a width of about 3.15 mm at the top portion 13*e*, the aperture 13*f* has a diameter of about 1.52 mm.

The housing 16 has an aperture 16*a* adapted to have the push button 14 extend therethrough. As shown in FIG. 1B, the housing 16 has a guard 16*b* around the aperture 16*a*. The housing 16 has a plurality of extrusions 16*c* adapted to fit into corresponding indentions 18*c* in the cover 18 when the contact assembly 10 is assembled. The cover 18 also has an internal extrusion 18*a* adapted to extend through a second portion of the spring member 12 to fix the second portion of the spring member 12 into place.

Figure 3:
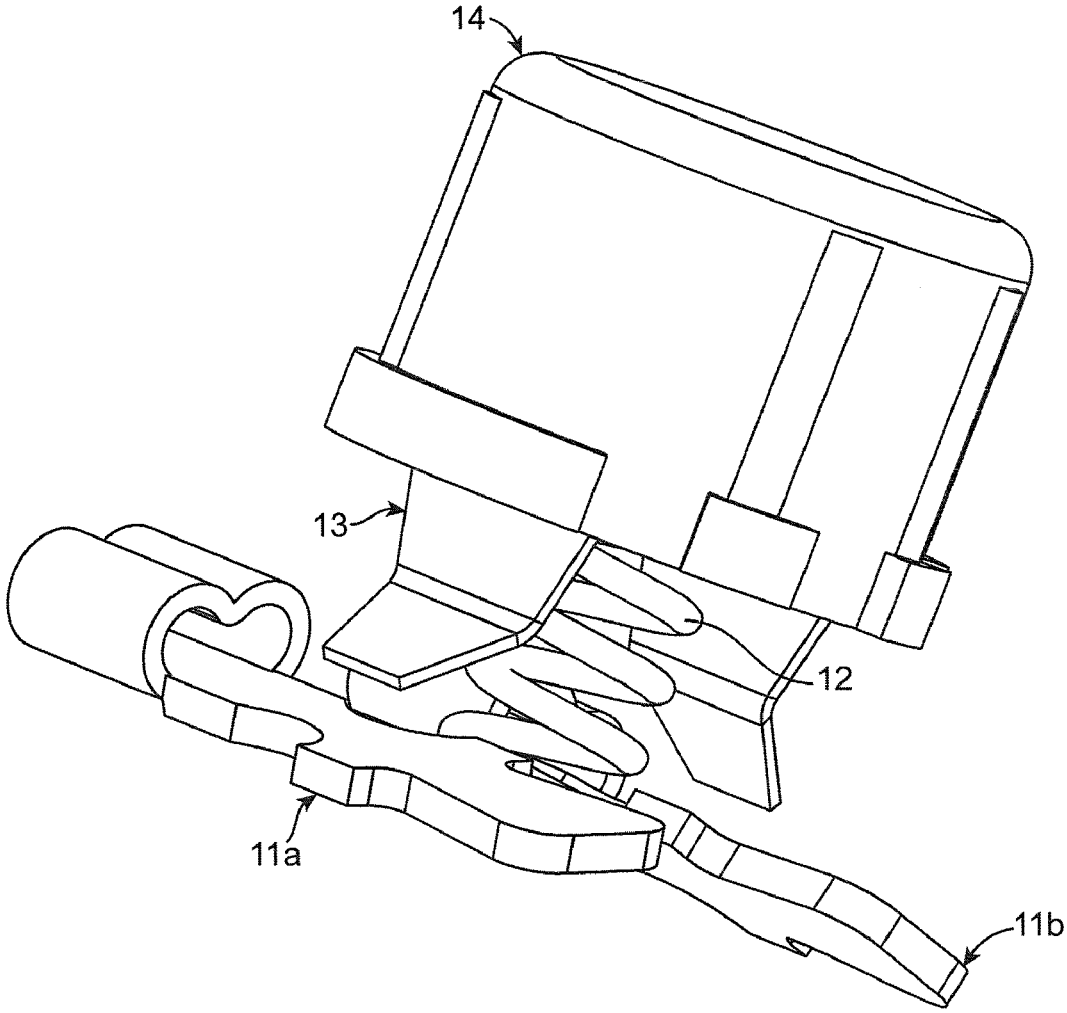
FIG. 3 is a perspective view of a partial, internal structure of the electrical contact assembly showing a contact member, a spring and a pair of electrical terminals, according to an embodiment of the invention.

FIG. 3 shows a perspective view of a partial, internal structure of the electrical contact assembly 10 showing only the terminals 11*a* and 11*b*, the spring member 12, the contact member 13, and the push button 14. In this state, the electrical contact assembly 10 is in a disconnected, or open, state since the electrically conductive contact member 13 is not in electrical contact with the terminals 11*a* and 11*b* to allow current to flow between the electrically conductive terminals 11*a* and 11*b* through the contact member 13.

Figure 4:
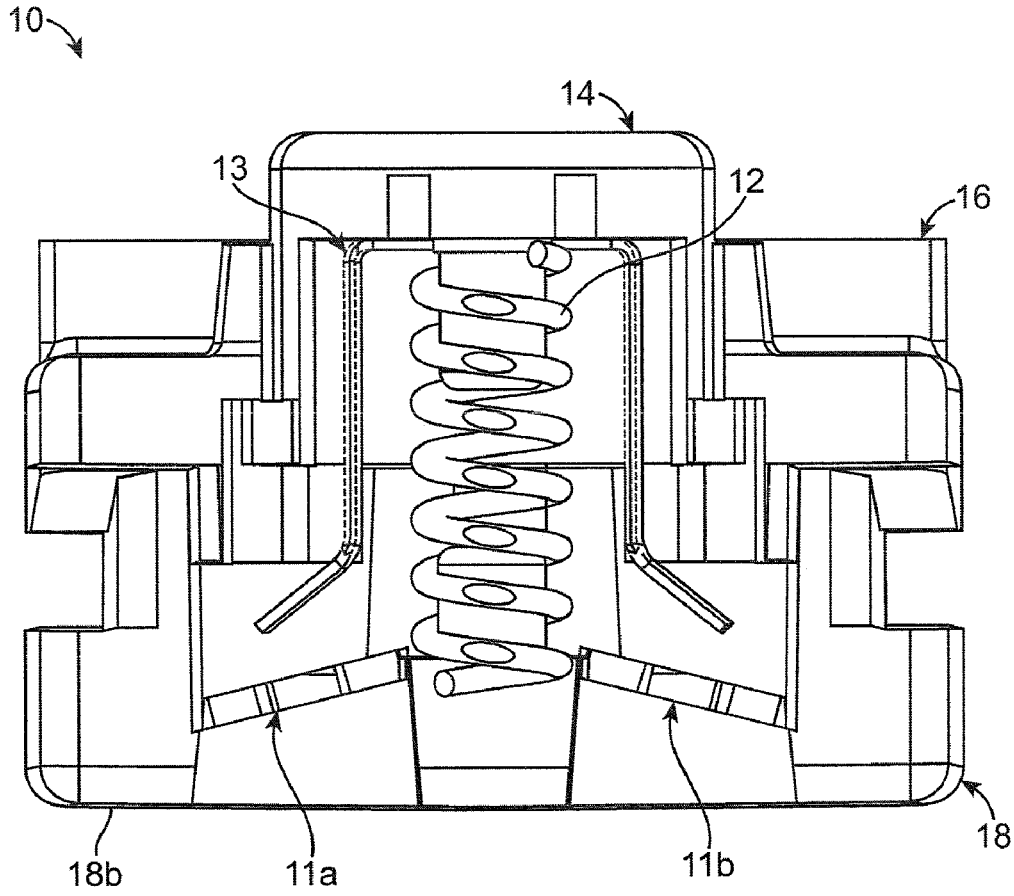
FIG. 4 is a cross-sectional view of the assembled contact assembly in its disconnected, or open, state, according to an embodiment of the invention.
Figure 5:
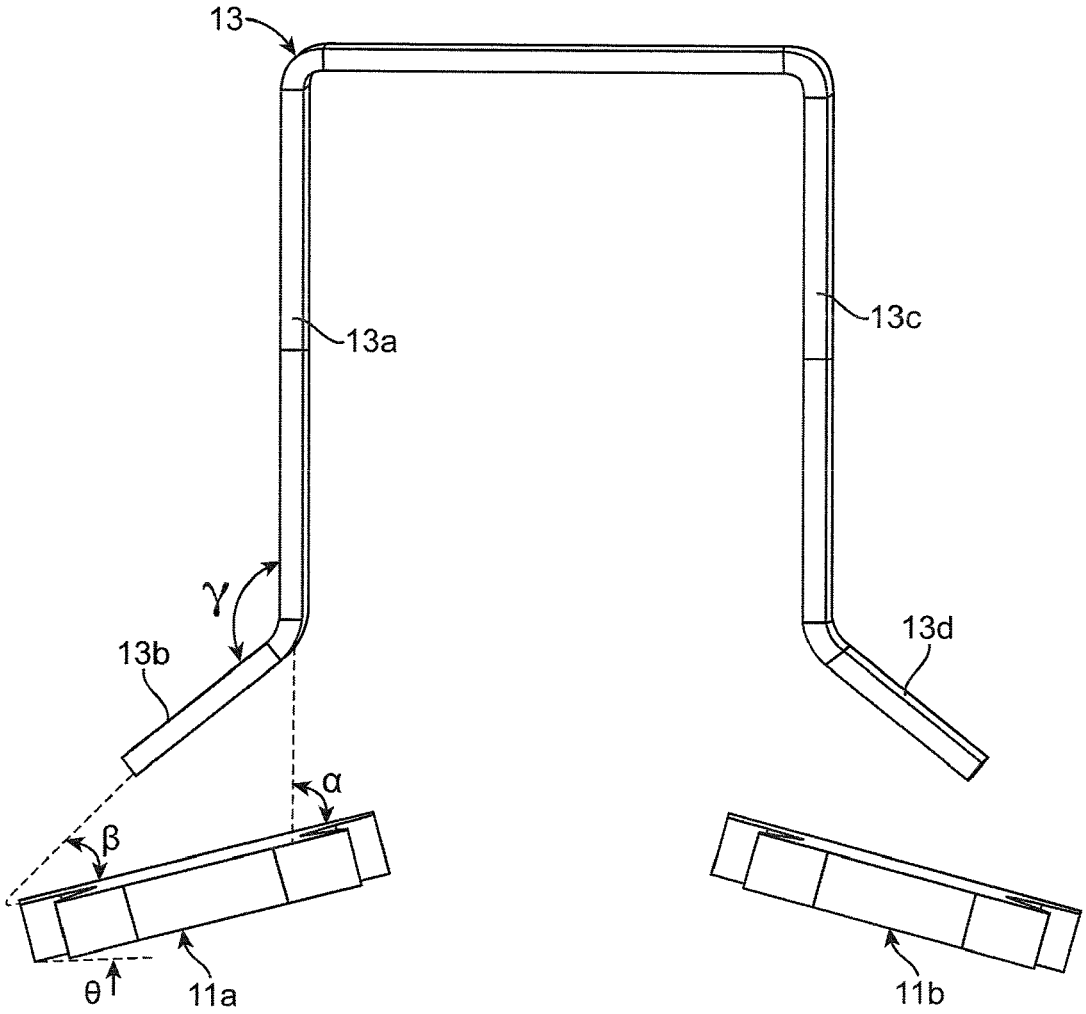
FIG. 5 shows the contact member and the electrical terminals of the contact assembly in greater details, according to an embodiment of the invention.

FIG. 4 shows a cross sectional view of the contact assembly 10 after it is assembled. In accordance with an embodiment of the invention, the electrical terminals 11*a* and 11*b* are slanted relative to the bottom surface 18*b* of the cover 18. As further shown in FIG. 5, the terminals 11*a* and 11*b* are slanted slightly upwardly relative to the bottom surface 18*b* of the cover 18, and form an angle $\theta$ relative to the bottom surface 18*b* of the cover 18. The angle $\theta$ is smaller than $\beta$, i.e., $0°<\theta<\beta$, and is preferably about 10°.

As shown in FIG. 4, the contact member 13 and the terminals 11*a* and 11*b* are normally in a disconnected, or open, state (i.e., the contact assembly 10 is "normally open"). As illustrated in detail in FIG. 5, the first contact portion 13*a* forms a first angle $\alpha$ with a surface 11*a*-1 of the electrical terminal 11*a*. The first angle $\alpha$ may be between about 20° and 90°, and preferably about 75°.

The second contact portion 13*b* forms a second angle $\beta$ with the surface 11*a*-1 of the terminal 11*a*. The second angle $\beta$ is smaller than the first angle $\alpha$, i.e., $0°<\beta<\alpha$, and preferably is about 25°. The first portion 13*a* and the second portion 13*b* form a relative angle $\gamma=180°-\alpha+\beta$, which is preferably about 130°.

In one exemplary implementation, the second portion 13*b* is angled (bent) about $\gamma=130°$ from the first contact portion 13*a*. In other words, the second portion 13*b* is angled (bent) about 50° vertically from the first contact portion 13*a*.

Figure 6A:
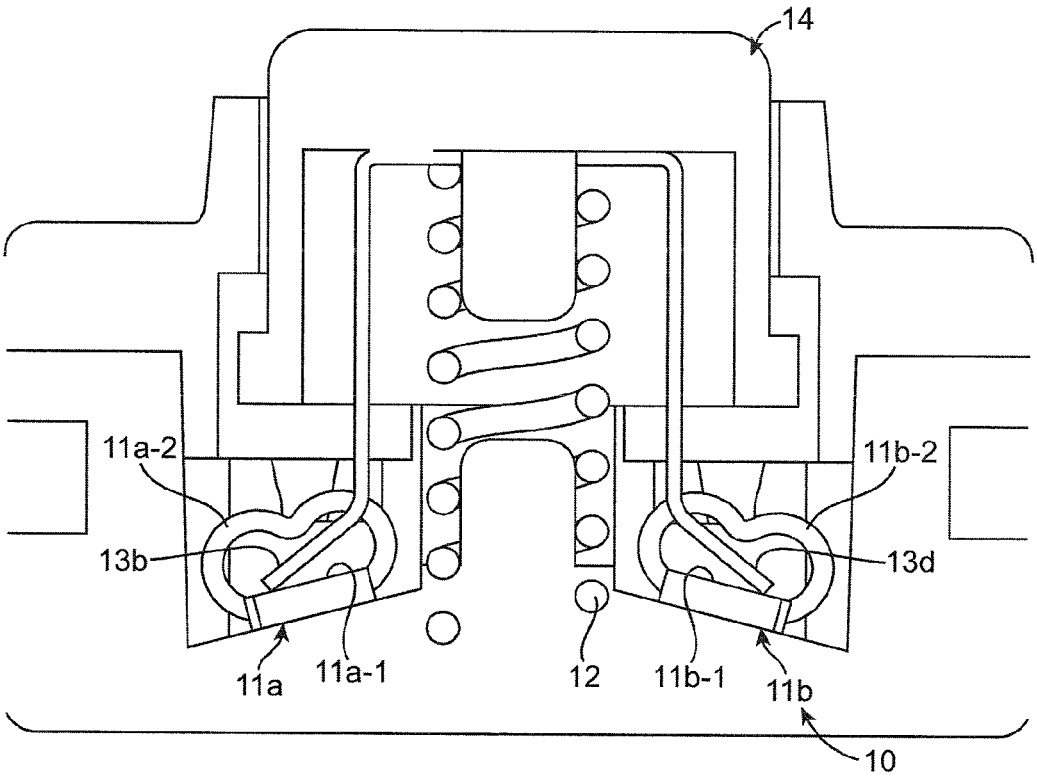
FIG. 6A is a cross-sectional view of the assembled contact assembly in its connected, or closed, state, according to an embodiment of the invention.

As shown in FIG. 6A, when the push button 14 is pressed, the contact member 13 is in turn pressed, compressing the spring member 12. The second contact portion 13*b* comes in contact with the surface 11*a*-1 of the first terminal 11*a*, and the fourth contact portion 13*d* comes in contact with the surface 11*b*-1 of the second terminal 11*b*. Electrical connection may thus be established between the terminals 11*a* and 11*b* through the contact member 13. In this state, the contact assembly 10 is connected, or closed. When wires 101*a* and 101*b* are connected to the terminals 11*a* and 11*b* as shown in FIG. 8B, the contact assembly 10 provides electrical connection between wires 101*a* and 101*b*.

The contact assembly 10 remains closed (providing electrical connection between the terminals 11*a*, 11*b*) so long as the spring member 12 remains compressed, allowing the contact member 13 to maintain electrical contact with both the terminals 11*a* and 11*b*.

Figure 6B:
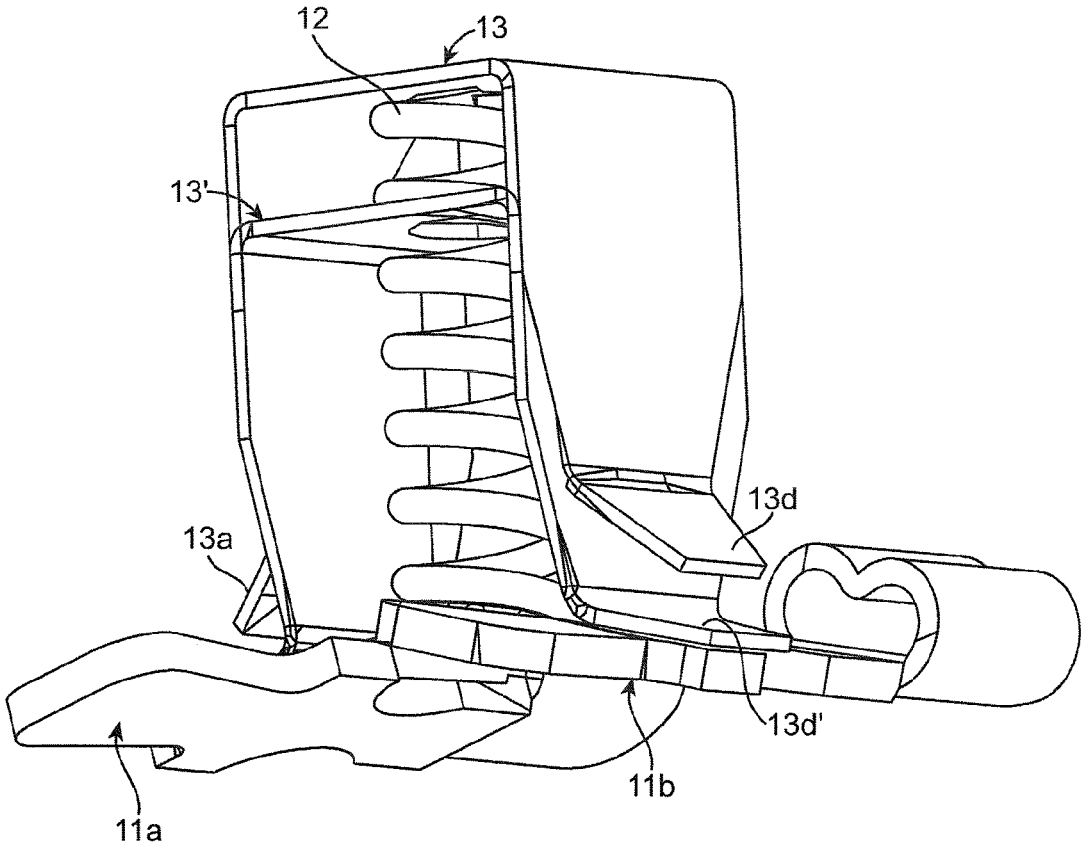
FIG. 6B is a perspective view comparing the open and the closed states of the contact assembly.

FIG. 6B further illustrates the contact member 13 in its open state and in its closed state 13'. In the closed state, the spring member 12 is compressed, and contact portions such as the portion 13*d'* are in electrical connections with terminals such as terminal 11*b*.

Figure 7A:
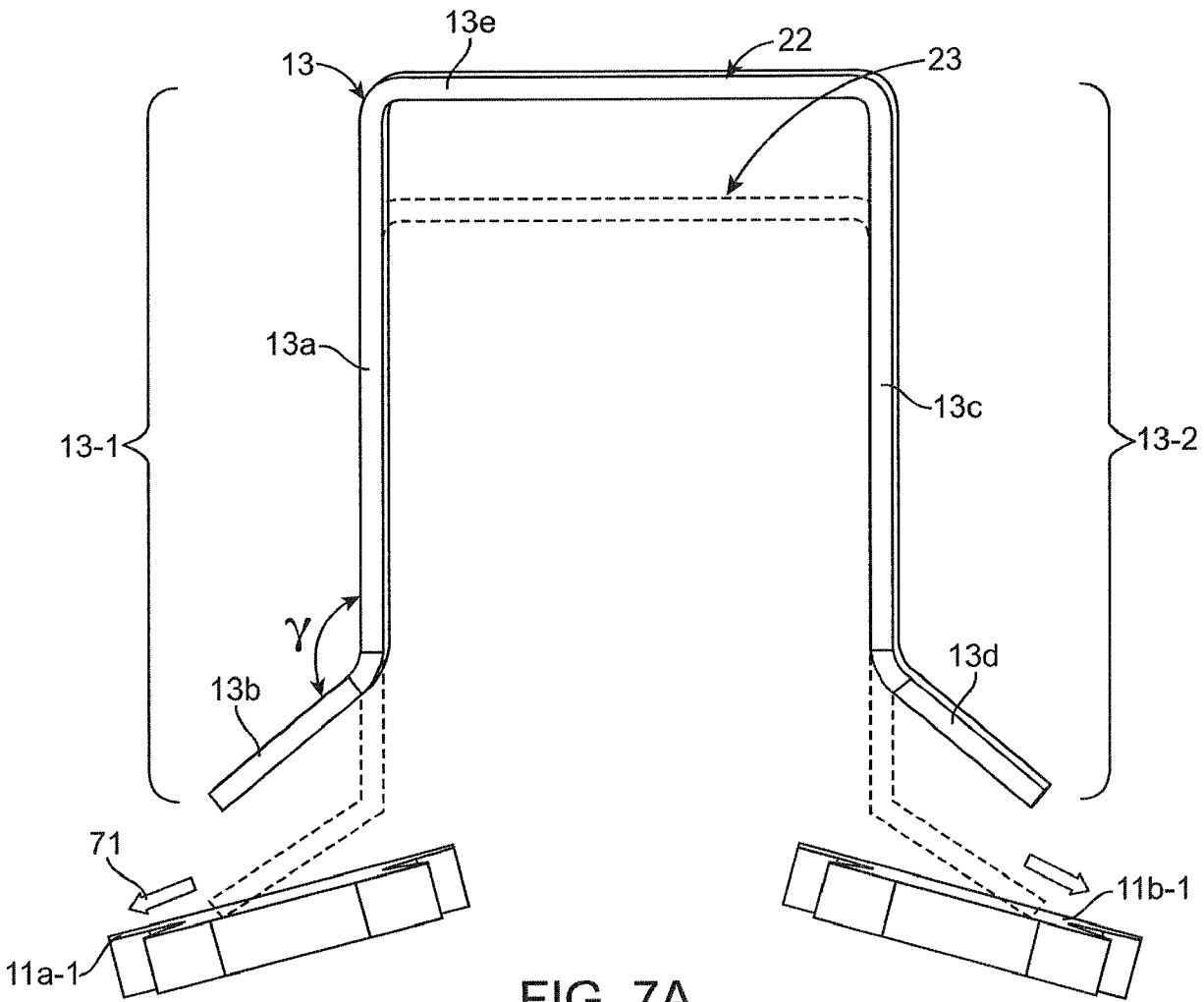
FIG. 7A shows relative positions of the contact member and the electrical terminals, according to an embodiment of the invention.
Figure 7B:
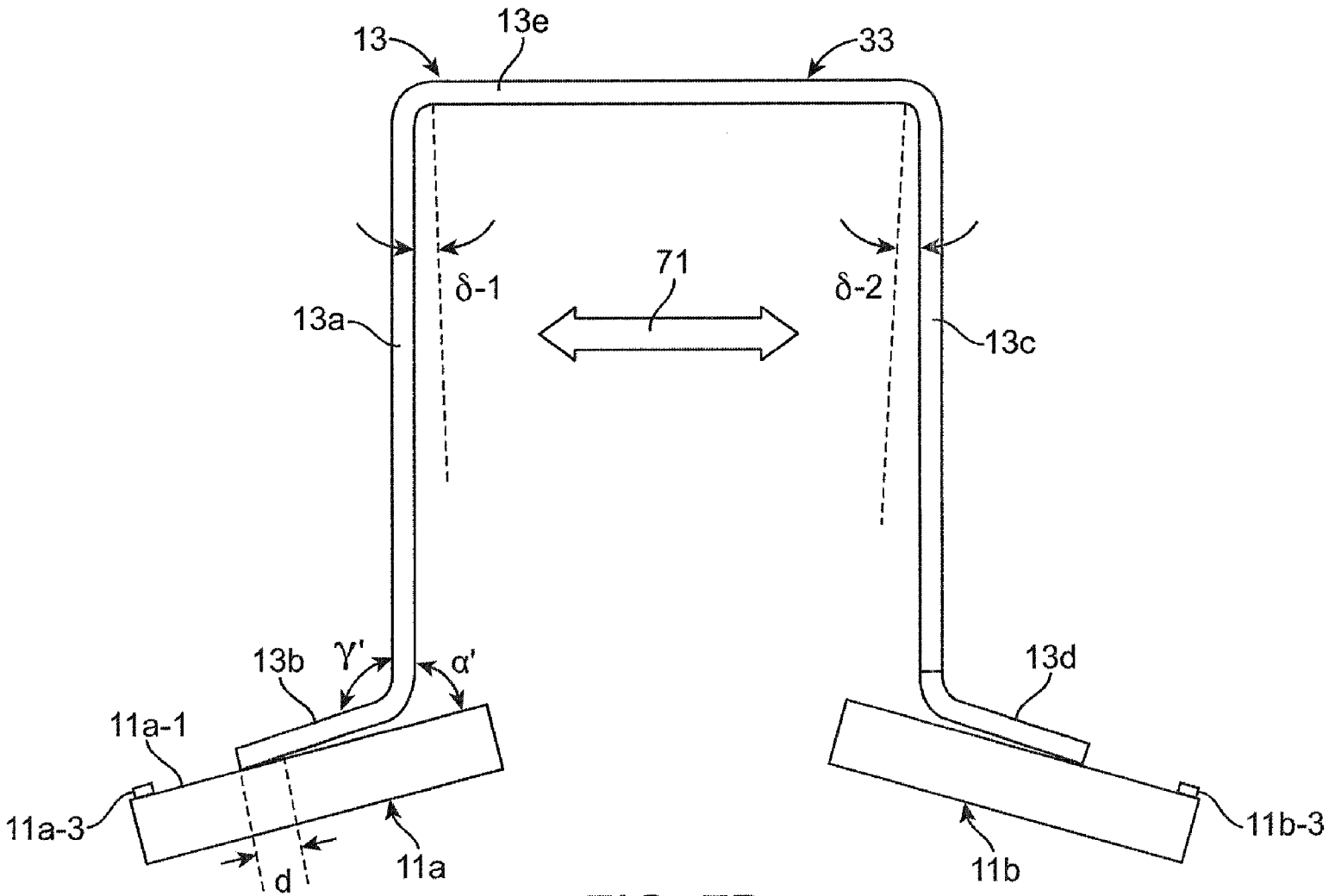
FIG. 7B shows the contact member in essentially complete contact with the electrical terminals, according to an embodiment of the invention.

As illustrated in FIG. 7A, and described above, when the contact member 13 is pushed down from its first position (normally open) 22 to a second position 23, the second contact portion 13*b* comes in initial contact with the surface 11*a*-1. When the push button 14 is pressed further, the contact member 13 is pushed to a third position 33 (FIG. 7B). The second contact portion 13*b* may be bent outwardly further, decreasing the relative angle $\gamma$ and the second angle $\beta$. Such a bending provides a resilient force on the contact member 13. This causes contact member leg 13-1 formed by the portions 13*a*, 13*b* to be pushed away from the contact member leg 13-2 formed by the portions 13*c*, 13*d*.

FIG. 7B shows the contact member 13 being pressed such that the contact portion 13*b* has its almost entire bottom surface in contact with the surface 11*a*-1 of the terminal 11*a*, after a tip of the contact portion 13*b* has slid on the surface 11*a*-1 for a distance d. The distance d may be comparable with the length of the second contact portion 13*b*, e.g., $0<d<1.5$ mm. As discussed further below, such a sliding range increases the reliability of the electrical connection.

The relative angle between the contact portions 13*a* and 13*b* decreases until the angle $\gamma'=180-\alpha'$ as shown, where the angle $\alpha'$ between the contact portion 13*a* and the surface 11*a*-1 may also have decreased, depending on the flexibility between the portion 13*a* and the top portion 13*e* of the contact member 13.

As shown earlier in FIG. 1, the width of the contact member 13 may be designed to taper down from the top portion 13*e* toward the contact portions 13*b* and 13*d*. For a switch assembly 10 having a width of about 12 mm and a thickness of about 9 mm, for example, the contact member 13 may be tapered down from the top portion 13*e* at a width of about 3.15 mm to a width of about 1.6 mm at the tip of the second contact portion 13*b*.

The tapered width of the contact member 13 provides a softer resilient force between the contact portions 13*a* and 13*b* as compared with the resilient force between the top portion 13*e* and the contact portion 13*a* when the contact member 13 is compressed. Thus, it is easier to bend the second contact portion 13*b* from the first contact portion 13*a* as compared with bending the first contact portion 13*a* from the top contact portion 13*e*. As illustrated in FIG. 7B, the first contact portion 13*a* may be bent from the top portion 13*e* for an angle $\delta$, e.g., about $0°<\delta<30°$. Preferably $\delta$ is limited to be less than about 26.2° to avoid damages to the contact member 13. This can be achieved, for example, by stop ribs 11*a*-3 and 11*b*-3 on the terminals 11*a* and 11*b*, respectively, or by the range of the top portion 13*e* can travel. The change in the angle $\gamma$, i.e., $\gamma-\gamma'$, is larger than $\delta$ because of the less resilient force between the portions 13*a* and 13*b* as compared with that between the first portion 13*a* and the top portion 13*e*.

Figure 7C:
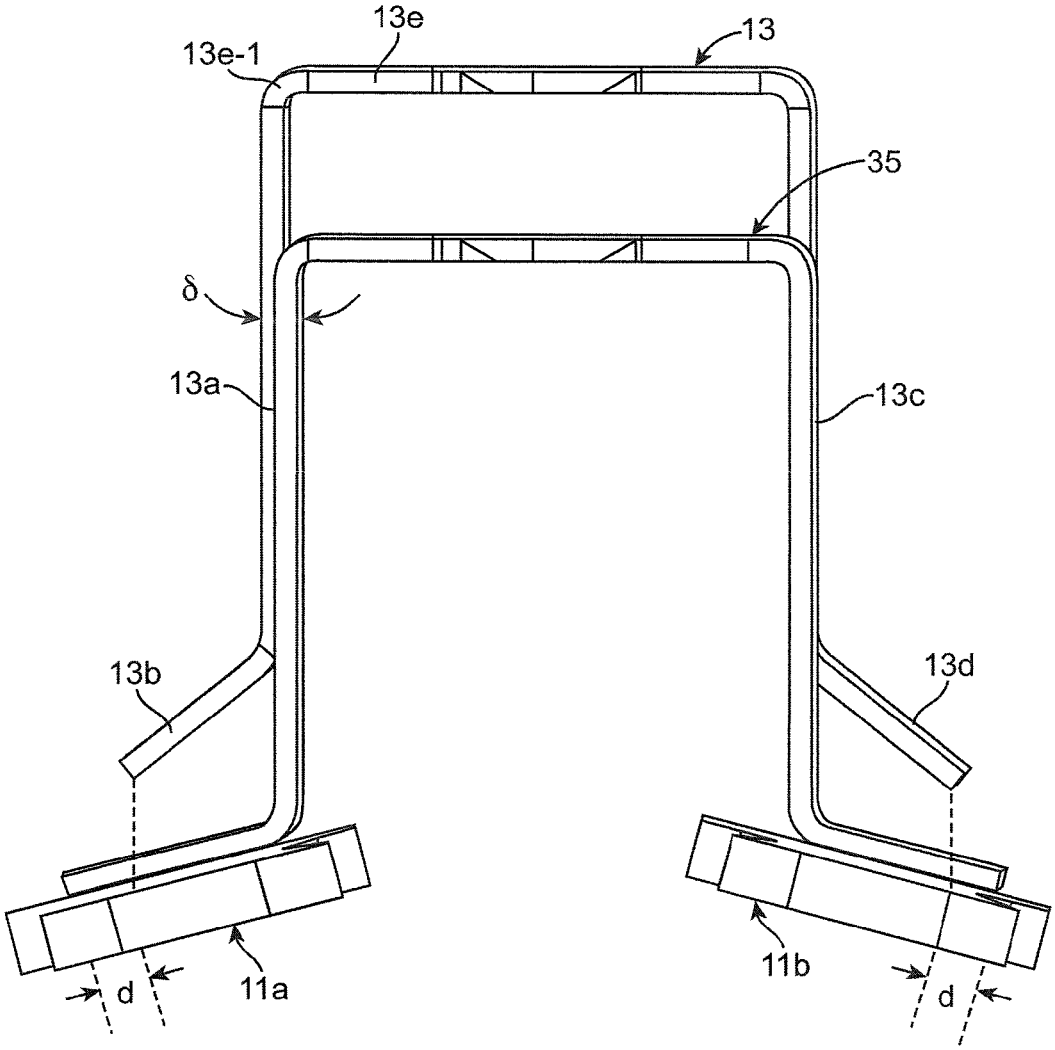
FIG. 7C shows the contact member in essentially complete contact with the electrical terminals without bending the top portion of the contact member, according to another embodiment of the invention.

As shown in FIG. 7C, according to another embodiment of the invention, the connection 13*e*-1 between the top portion 13*e* and the first portion 13*a* is so rigid that $\delta=0$ even after the tip of the second contact portion 13*b* has slid for a distance d on the terminal 11*a* when the contact member 13 is pressed to a position 35. Those of ordinary skill in the art will recognize that other variations of the contact member 13 are possible. For example, the contact portions 13*a* and 13*c* may not be parallel even in an "open" state. Rather, an angle may exist between the portions 13*a* and 13*c*. Further, the top portion 13*e* may be smaller than shown, or may be so small that the contact member 13 is essentially "V" shaped instead of "U" shaped. In this case, a resilient force may be provided directly between the portions 13*a* and 13*c*. Moreover, contact portions 13*b* and 13*d* may not be necessary, and the tips of portions 13*a* and 13*c* may directly slide on the terminals 11*a* and 11*b*.

Figure 7D:
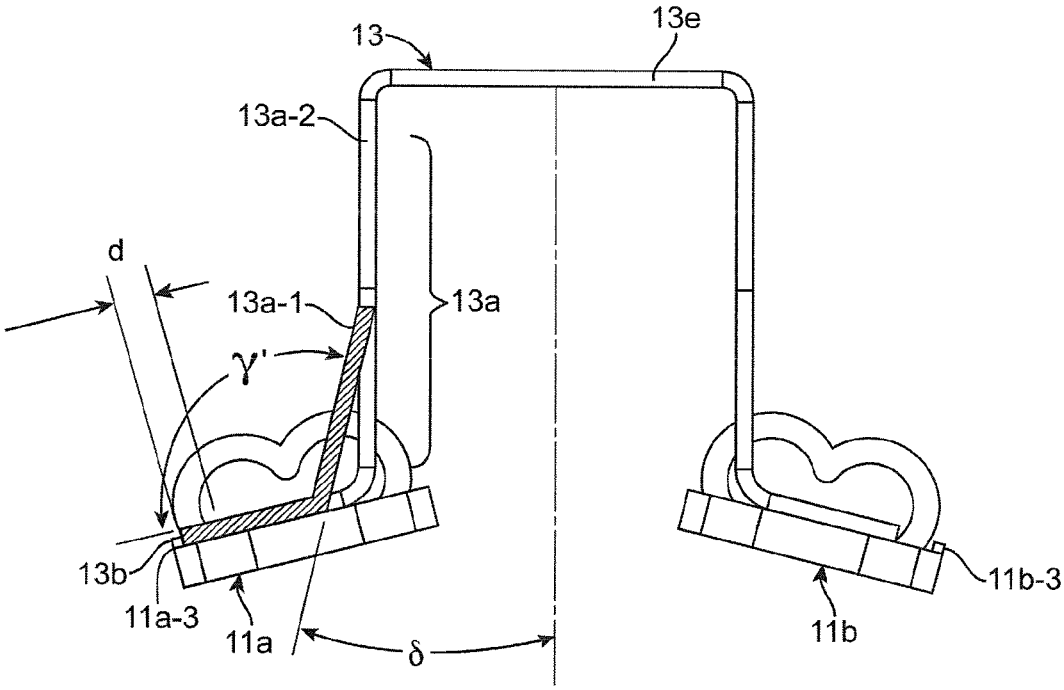
FIG. 7D shows the contact member in essentially complete contact with the electrical terminals, according to another embodiment of the invention.

FIG. 7D shows yet another embodiment of the contact member 13. As shown, the first contact portion 13*a* comprises two portions 13*a*-1 and 13*a*-2, and the deflection or bending of the contact member 13 may occur between these two portions 13*a*-1 and 13*a*-2 in addition to between the second contact portion 13*b* and the first contact portion 13*a*. The second contact portion 13*b* as shown is in essentially complete contact with the terminal 11*a*. When the contact member 13 is pressed further, a further deflection may occur between these two portions 13*a*-1 and 13*a*-2 in addition to, or alternative to, the deflection between the first contact portion 13*a* and the top contact portion 13*e*. As shown δ increases from about 0° to about 13.1°, while the angle γ' reaches about 118.1°. The tip of the second contact portion 13*b* slides for a distance d of about 0.40 mm before being stopped by the rib 11*a*-3.

The resilient force causes an outwardly sliding tendency of the second portion 13*b* on the surface 11*a*-1. When the sliding tendency overcomes the friction between the second portion 13*b* and the surface 11*a*-1, at least a tip of the second contact portion 13*b* slides outwardly on the surface 11*a*-1, in the direction shown as a block arrow 71 in FIG. 7A. The sliding tip of the second contact portion 13*b* cleans a portion of the surface 11*a*-1 to remove, for example, oxidation layers, dust, and other contaminations that may cause a bad electrical contact. This is a self-cleaning action that allows proper electrical contact between the terminal surfaces 11*a*-1, 11*b*-1 and the contact portions 13*a*, 13*d*, respectively.

Even after repetitive open and close state cycles of the contact 20 assembly (switch 10) such that wearing on the contact portions 13*b*, 13*d* and the surfaces 11*a*-1 and 11*b*-1 may occur, proper electrical contact may still be ensured as a result of the range of relative positions (between position 23 and position 33) the contact member 13 can move while trying to make electrical contact with terminals 11*a* and 11*b*. Thus, the contact assembly 10 of the invention provides a reliable electrical connection through the "self cleaning" function and the range of contact positions.

As noted, when the push button 14 is pressed, the spring member 12 is compressed. When the push button 14 is partially released, the second portion 13*b* slides back on the surface 11*a*-1 of the terminal 11*a* as a result of the resilient force between the contact member 13 and the surface 11*a*-1. When the push button 14 is further released, the contact member is moved by the spring member 12 passing the second position 23, and the second portion 13*b* breaks electrical contact with the surface 11*a*-1.

In another embodiment of the present invention, the push button 14 may be locked into one or more lock positions using mechanisms known in the art.

FIG. 8A shows a portion of an electrical system 100 including a plurality of contact assemblies 10*a*, 10*b*, and 10*c* according to an embodiment of the present invention. Each of the contact assemblies 10*a*, 10*b*, and 10*c* is similar to the contact assembly 10 (e.g., FIGS. 1A-2) described above.

As shown in FIG. 8A, contact assembly 10*a* acts as a single termination for electrical wires 101*a* and 101*b*, while contact assembly 10*b* acts as a double termination for wires 101*a*, 101*b*, 101*c* and 101*d*. A conventional switch 80 may also be included in the circuitry. FIG. 8B shows the electrical system 100 with the contact assemblies partially removed, exposing the electrical terminals such as 11*a* and 11*b*. FIG. 8C shows further details of an electrical terminal 81. The retaining portion 81-1 of the terminal 81 retains two wires 83 and 85. Thus terminal 81 can be used to as a splitting point for wires 83 and 85.

Advantageously, the invention provides a reliable and durable electrical switch. The switch has a "self-cleaning" function that helps maintain a reliable electrical connection.

The present invention has been described in considerable detail with reference to certain preferred versions thereof; however, other versions are possible.

For example, those of ordinary skill in the art will recognize that many design variations of the contact member 13 may exist without departing the scope of the invention. The contact member 13 may have more "legs," and each leg may include more than two portions having different relative angles with respect to the corresponding electrical terminal. The dimensions and the materials of the portions may vary.

In addition, the different portions may be made separately and then coupled together. Moreover, although the contact member 13 as shown has two, symmetrical legs each having two portions, the legs may be configured asymmetrically. Moreover, although the contact member as shown in the drawings is "bent" outwardly, it is possible that it can be designed to be bent inwardly; so long the terminals are slanted inwardly accordingly.

Therefore, the spirit and scope of the appended claims should not be limited to the description of the preferred versions contained herein.

What is claimed is:

1. An electrical contact assembly, comprising:

a slanted electrical terminal;

a push button; and a contact member disposed between the electrical terminal and the push button, the contact member comprising:

a first portion forming a first angle in relation to a surface of the electrical terminal; and a second portion, connected to the first portion, and forming a second angle in relation to the surface of the electrical terminal, wherein the second angle is unequal to the first angle, such that the second portion is adapted to make contact with, and slide on the surface of the electrical terminal as the push button is pushed against the contact member, wherein the second portion is substantially parallel to the electrical terminal when in contact.

2. The electrical contact assembly of claim 1, further comprising a spring member coupled with a portion of the push button and a bottom portion of a cover to normally maintain the contact member away from the electrical terminal.

3. The electrical contact assembly of claim 1, further comprising a housing and a cover together substantially enclosing the electrical terminal and the contact member.

4. The electrical contact assembly of claim 1, further comprising a retainer adapted for retaining an electrical wire, wherein the retainer is in electrical contact with the electrical terminal.

5. The electrical contact assembly of claim 1, wherein:

the electrical terminal has an essentially planar surface, the first portion of the contact member is transverse in relation to said surface of the electrical terminal and the second portion is transverse in relation to said surface of the electrical terminal, such that the second angle is less than the first angle.

6. The electrical contact assembly of claim 1, wherein the contact member comprises beryllium copper.

7. The electrical contact assembly of claim 1, wherein the second portion is adapted to wipe a portion of the surface of the electrical terminal when sliding on said surface.

8. The electrical contact assembly of claim 1, wherein the contact member further comprises:

a third portion and a fourth portion symmetrical in configuration to the first portion and the second portion, respectively; and a top portion connecting the first and the third portions, forming an essentially U-shaped contact member.

9. The electrical contact assembly of claim 1, further comprising a spring member coupled to the contact member and to the push button, wherein an opening is defined in the top portion of the contact member to axially receive an extrusion of the push button therethrough extending through a portion of the spring member as the push button is urged against the contact member.

10. The electrical contact assembly of claim 1, wherein the contact member is adapted to provide a resistive mechanical force between the push button and the electrical terminal when in electrical contact with the electrical terminal, the resistive force at least partially resulting from a change in a relative angle between the first portion and the second portion as the push button is urged against the contact member.

11. The electrical contact assembly of claim 10, wherein the relative angle between the first portion and the second portion is about 130° when the contact member is not in electrical contact with the electrical terminal.

12. The electrical contact assembly of claim 1, wherein the first angle is between about 20° and 90°.

13. The electrical contact assembly of claim 12, wherein the first angle is about 75°.

14. The electrical contact assembly of claim 12, wherein the second angle is about 25°.

15. An apparatus, comprising:

a plurality of slanted electrical terminals;

a switch for making an electrical connection between at least two of the plurality of electrical terminals, wherein the switch comprises:

a push button; and an essentially U-shaped contact member disposed between the electrical terminals and the push button, and adapted to provide an electrical connection between a first terminal and a second terminal when the push button is urged against the contact member to bring the contact member in electrical contact with the first and second electrical terminals to electrically close the switch, the contact member comprising:

a first element forming a first transverse angle in relation to a surface of the first electrical terminal; and a second element forming a second transverse angle in relation to a surface of the second electrical terminal;

such that at least a portion of the first element is adapted to make contact with and slide on the surface of the first electrical terminal as the push button is urged against the contact member, and at least a portion of the second element is adapted to make contact with and slide on the surface of the second electrical terminal as the push button is urged against the contact member, whereby the contact member provides an electrical connection between the first and second electrical terminals, wherein all of a flat surface of the first element is coupled with the first electrical terminal when the push button is depressed.

16. The apparatus of claim 15, wherein the contact member is adapted to reversibly deform as the push button is urged against the contact member, to allow a change in the first angle that enables a tip portion of the first element to slide on the surface of the first electrical terminal, and to allow a change in the second angle that enables a tip portion of the second element to slide on the surface of the second electrical terminal.

17. The apparatus of claim 16, wherein:

the contact member further comprises a top element connecting the first and second elements;

the first element includes a mid portion connecting the tip portion of the first element to the top element, the mid portion of the first element forming a third transverse angle in relation to the tip portion of the first element, the second element includes a mid portion connecting the tip portion of the second element to the top element, the mid portion of the second element forming a fourth transverse angle in relation to the tip portion of the second element.

18. The apparatus of claim 17, further comprising a spring member disposed between at least a portion of the contact member and the terminals to normally maintain the contact member away from the electrical terminals to electrically open the switch.

19. The apparatus of claim 18, wherein the spring member provides a counter force to disconnect the contact member from the first and second electrical terminals when the push button is not urged against the contact member, thereby transitioning the switch from electrically closed to electrically open.

20. The apparatus of claim 19 further comprising a housing and a cover together substantially enclosing the electrical terminals and the contact member, the housing forming an opening that slidably retains at least a portion of the push button, such that a top portion of the push button is exposed outside the housing to allow urging the push button against the contact member to electrically close the switch.

21. An electrical system, comprising:

a plurality of electrical terminals; and a switch for making an electrical connection between at least two of the plurality of electrical terminals, wherein the switch comprises:

a push button; and a contact member disposed between the electrical terminals and the push button, and adapted to provide an electrical connection between a first terminal and a second terminal when the push button is urged against the contact member to bring the contact member in electrical contact with the first and second electrical terminals, the contact member comprising:

a first element forming a first transverse angle in relation to a surface of the first electrical terminal;

a second element, connected to the first element, and forming a second transverse angle in relation to the surface of the first electrical terminal; and a third element connected to the first element;

such that the second element is adapted to make contact with, and slide on the surface of the first electrical terminal as the push button is urged against the contact member, and the third element is adapted to make contact with the second electrical terminal as the push button is urged against the contact member, whereby the contact member provides an electrical connection between the first and second electrical terminals, wherein all of a flat surface of the second element is coupled with the first electrical terminal when the push button is depressed.

22. The electrical system of claim 21, wherein the second element is adapted to wipe a portion of the surface of the first electrical terminal when sliding on the surface.

23. The electrical system of claim 21, wherein the contact member is adapted to provide a resistive mechanical force against the push button when in electrical contact with the first electrical terminal and the second electrical terminal, the resistive force resulting from a change in a relative angle between the first element and the second element.

24. The electrical system of claim 21, wherein the switch further comprises a spring member disposed between a portion of the contact member and terminals, for providing a counter spring force to disconnect the contact member from the first electrical terminal and the second electrical terminal when the push button is not urged against the contact member.

25. The electrical system of claim 21, further comprising a spring member to normally maintain the contact member away from the electrical terminals.

* * * * *